US006046738A

United States Patent [19]

Eglit et al.

[11] Patent Number: 6,046,738

[45] Date of Patent: Apr. 4, 2000

[54] METHOD AND APPARATUS FOR SCANNING A DIGITAL DISPLAY SCREEN OF A COMPUTER SCREEN AT A HORIZONTAL SCANNING FREQUENCY LOWER THAN THE ORIGIN FREQUENCY OF A DISPLAY SIGNAL

[75] Inventors: Alexander Julian Eglit, Half Moon Bay; Robin Sungsoo Han, Saratoga, both of Calif.

[73] Assignee: Genesis Microchip Corp., Mountain View, Calif.

[21] Appl. No.: 08/909,825

[22] Filed: Aug. 12, 1997

[51] Int. Cl.[7] ..... G09G 5/30

[52] U.S. Cl. ..... 345/213; 345/132; 345/3; 713/322

[58] Field of Search ..... 345/10, 132, 3, 345/130, 127; 395/556, 750; 713/322

[56] References Cited

U.S. PATENT DOCUMENTS

| | | | |
|---|---|---|---|
| 3,716,658 | 2/1973 | Rackman | 178/7.3 D |
| 5,047,759 | 9/1991 | Takebe et al. | 340/789 |
| 5,103,218 | 4/1992 | Takeda | 340/784 |
| 5,307,085 | 4/1994 | Nakamura | 345/99 |
| 5,396,258 | 3/1995 | Zenda | 345/3 |
| 5,404,153 | 4/1995 | Kim | 345/213 |
| 5,610,621 | 3/1997 | Itoh et al. | 345/3 |
| 5,615,376 | 3/1997 | Ranganathan | 713/322 |
| 5,625,359 | 4/1997 | Wilson et al. | 341/143 |
| 5,742,274 | 4/1998 | Henry et al. | 345/132 |
| 5,757,388 | 5/1998 | Bassetti et al. | 345/3 |
| 5,758,135 | 5/1998 | Tucker et al. | 395/556 |

FOREIGN PATENT DOCUMENTS

| | | | |
|---|---|---|---|
| 412188788 | 7/1990 | Japan | G09G 5/18 |
| 2234382 | 1/1991 | United Kingdom | G09G 3/18 |

*Primary Examiner*—Steven J. Saras
*Assistant Examiner*—Fritz Alphonse
*Attorney, Agent, or Firm*—Law Firm of Naren Thappeta

[57] ABSTRACT

A digital display unit receiving a display signal with image encoded at high origin frequencies (e.g., dot clock). A display signal interface samples the display signal during source display time to generate pixel data elements representative of the images encoded in the display signal. The signal is sampled at a sampling frequency equal to origin frequency. The pixel data elements are stored in a buffer at the sampling frequency and retrieved at a slower frequency. Display signals are generated for each horizontal scan line of a digital display screen during a destination display time at this slower frequency. The destination display time is designed to be longer than the source display time, which enables the display signals to be generated from all pixel data elements. The destination display time is longer than the source display time because digital display units do not require the long non-display times present in the display signals.

30 Claims, 4 Drawing Sheets

METHOD AND APPARATUS FOR SCANNING A DIGITAL DISPLAY SCREEN OF A COMPUTER SCREEN AT A HORIZONTAL SCANNING FREQUENCY LOWER THAN THE ORIGIN FREQUENCY OF A DISPLAY SIGNAL

RELATED APPLICATIONS

The present application is related to the following co-pending Patent Applications, which are both incorporated in their entirety into the present application herewith:

1. Patent Application entitled, "A Method and Apparatus for Upscaling an Image", Filed Feb. 24, 1997, having Ser. No. 08/804,623; and
2. Patent Application entitled, "A Method and Apparatus for Clock Recovery in a Digital Display Unit", Filed Feb. 24, 1997, having Ser. No. 08/803,824.

BACKGROUND OF THE INVENTION

1. Field of the Invention

The present invention relates to computer graphics systems, and more specifically to a method and apparatus for scanning a digital display screen of a computer screen at a horizontal scanning frequency lower than the origin frequency of a display signal.

2. Related Art

Digital display units are often used in computer systems to display images. Typically, an image is sent to a digital display unit encoded in the form of a display signal (e.g., RGB analog signals or PanelLink digital signal) and the display unit reproduces the image represented by the display signal. Digital display units are characterized by discrete points (referred to as "pixels") on a display screen, and these points are typically activated individually based on the received display signal. An image is produced as a result of such collective actuation of the pixels.

When encoding an image in a display signal, a graphics source may encode display data at a given frequency (hereafter "origin frequency"). For example, in an SVGA compatible environment well known in the art, an image may be first represented as discrete pixel data elements at a graphics source, and an analog display signal may be generated from these pixel data elements at what is commonly known as a dot clock frequency. The analog display signal encoded with the display data at the origin frequency is transmitted to a digital display unit for display on a digital display screen.

There is a tendency in the industry to provide display signals at higher origin frequencies as the higher frequencies enable higher refresh rates (the number of images scanned/displayed per second on a display screen) and finer resolutions. High refresh rates generally lead to images of better display quality (e.g., reduced flicker) and finer resolutions can provide for more detail in the displayed images as is well known in the art. As an illustration, the origin frequency in an SVGA compatible environment is computed by multiplying the desired refresh rate, the number of horizontal lines in each frame, and the total number of samples in each horizontal line. Some earlier systems generated display signals at an origin frequency of as low as 110 MHZ, while the present systems can generate display signal at an origin frequency of 250 MHZ.

A digital display unit receives a display signal with the encoded image, samples the received display signal to generate sampled pixel data elements, and actuates individual pixels of a digital display screen based on the sampled pixel data elements to generate an image. In general, it is desirable that the encoded signal be sampled at a sampling frequency equal to origin frequency for a proper reproduction of an image encoded in the display signal as is well known in the art.

Further, the digital display screen may need to be refreshed with each image encoded in each frame of the received signal. Accordingly, some prior systems may refresh the display screen using a horizontal scanning frequency (hereafter 'scanning frequency') equal to the sampling frequency, at least in situations when upscaling is not required.

However, it may be desirable to scan a digital display screen at a scanning frequency lower than the origin frequency of the received display signal. For example, some digital display screens may not be implemented to operate at horizontal scanning frequencies as high as the sampling frequency (or origin frequency) of the received display signals. A digital display may not be able to operate at high scanning frequencies as the electronic circuitry which actuates individual pixels on a digital display screen may not be designed (or otherwise be incapable of operating) for scanning frequencies as high as a corresponding sampling clock frequency. In such situations, it may not be possible to display the images encoded in the received display signals. Such inability to display images may not be unacceptable.

It may be desirable to scan digital display screens at lower frequencies for other reasons as well. For example, in some power constrained environments such as notebook computers, it may be desirable to scan digital display screens at lower horizontal frequency as such slower speed of operations generally consumes less electrical power.

Thus, what is needed is a method and apparatus for scanning a digital display screen of a computer screen at a horizontal scanning frequency lower than the origin frequency of a received display signal.

SUMMARY OF THE INVENTION

The present invention is directed to a digital display unit used in a computer system. A digital display unit in accordance with the present invention receives a display signal having an origin frequency (e.g., dot clock in SVGA type environments). The display signal is sampled at origin frequency. However, a digital display screen is scanned at horizontal scanning frequency (hereafter "scanning frequency") which is less than the origin frequency. Such scanning results in the generation of images on the digital display screen.

The present invention enables such a reduction in frequency (from sampling frequency to the lower scanning frequency) by using an intermediate buffer. The pixel data elements resulting from sampling a received display signal are stored in the buffer at the sampling frequency. The sampled pixel data elements are retrieved at the lower scanning frequency.

Display signals are generated immediately from the retrieved pixel data elements such that the digital display screen in scanned at the lower scanning frequency.

Even though the pixel data elements are retrieved from the buffer at a lower frequency (equal to the scanning frequency), the entire image encoded in the received display signal can be displayed. The reason for avoiding image loss can be appreciated by considering the manner in which display signals are encoded as explained below.

Typically, each frame of a display signal includes several horizontal lines. In turn, each horizontal line includes active display signal portion encoding an image, and a non-display portion (retrace portion) representing a transition to a next horizontal line. When displaying an image encoded in such a display signal, display units transition display to a next horizontal line generally corresponding to a time (non-display time) during which the retrace signal portion is received.

The non-display time is generally a fairly large portion of the total display signal time for display signals designed for analog display units (based on raster scan techniques). The non-display time is large because of the large amount of time it generally takes to move the scanning point from the end of one horizontal line to the beginning of a next horizontal line.

However, for digital display units the non-display time can be much shorter (compared to analog display environments) as transitioning display to a next horizontal line typically requires manipulating a few counters as is well known in the art.

The present invention takes advantage of the disparity in these non-display times. Specifically, when a display signal having high non-display times is received, the samples representing the image encoded in the display signal are stored in a buffer, and the samples are retrieved at a slower frequency by extending the retrieval time into the non-display time of the received display signal. That is, the non-display time in the digital display unit is designed to be smaller than the non-display time in the received display signal, which allows the digital display screen to be scanned at a slower frequency. As a result, the entire image encoded in a received display signal can be displayed on the digital display screen.

Thus, even though the digital display screen is scanned at a slower frequency than the sampling frequency, the entire image encoded in the received display signal can be displayed.

The invention can be applied in computer systems which include a digital display unit having a maximum horizontal scanning frequency which is lesser than the origin frequency. The digital display unit may be limited in the speed of operation, for example, as the column driver circuits generating display signals for digital display screens may be designed to operate only at lower speeds. As the display signals can be generated at a frequency lesser than the maximum horizontal scanning frequency of the digital display unit, the present invention enables analog display signals at high origin frequencies to operate with digital display units having low maximum scanning frequencies.

The present invention can be applied in other environments as well. For example, a digital display unit in accordance with the present invention can operate consuming less electrical power as the digital display screen is scanned at a lower scanning frequency. This may be particularly advantageous in environments (e.g., notebook computers), where power conservation is critical.

Due to the operation at lower scanning frequency, the present invention provides the additional advantage of providing lower EMI emissions. Large EMI emissions may be undesirable, for example, in airplanes as the emissions can interfere with navigational controls.

Thus, the present invention enables the usage of all pixel data elements representative of images encoded in the received analog display signal by making use of the high horizontal non-display time characteristic of display signals designed for analog display units.

Further features and advantages of the invention, as well as the structure and operation of various embodiments of the invention, are described in derail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE DRAWINGS

The present invention will be described with reference to the accompanying drawings, wherein.

DETAILED DESCRIPTION OF THE PREFERRED EMBODIMENTS

Figure 1:
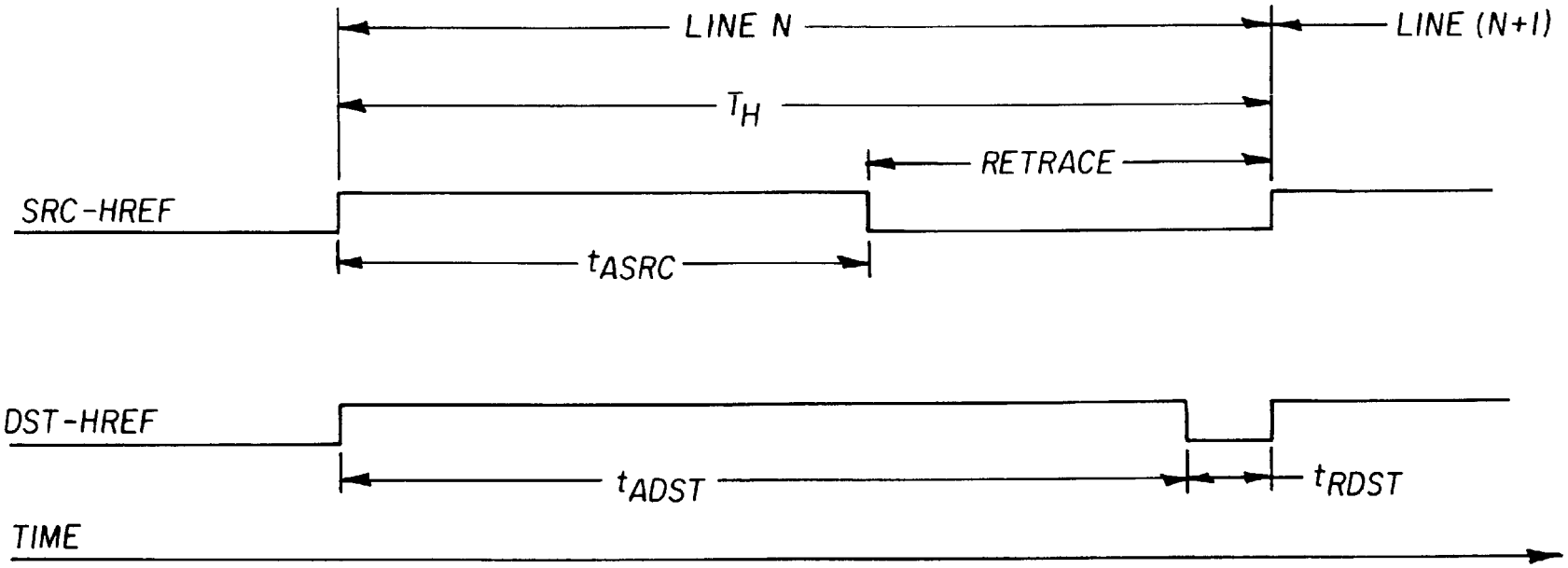
FIG. 1 is a timing diagram illustrating the timing relationship of storing and retrieving sampled pixel data elements which enables a digital display unit to be scanned at a lower frequency than the origin frequency at which an analog display signal is received.

1. Overview and Discussion of the Invention

A digital display unit in accordance with the present invention receives a display signal (e.g., RGB analog signals or PanelLink digital signal) in a format designed for an analog display unit. Signals designed for analog display units are characterized by high non-display times (e.g., horizontal retrace times) to enable the scan circuitry in analog display units to move the scan position (point) from the end of a horizontal line to the beginning of the next horizontal line as is well known in the art.

However, such high non-display times are generally not required for transitioning display to subsequent horizontal lines in digital display units. Therefore, the present invention takes advantage of this principle (or observation) to enable digital display screens to be scanned at low horizontal scanning frequencies.

The present invention can be applied in several environments. In one embodiment, the present invention is used in a digital display unit which has a maximum horizontal scanning frequency (explained below) less than the origin frequency of the received display signal. The present invention will be explained mostly in the context of this embodiment. However, it should be understood that the present invention can be implemented in other embodiments as well.

For example, the present invention can be implemented in notebook type computer systems in which electrical power consumption is of particular interest. Specifically, as digital display units operating at lower horizontal scanning frequencies consume less power, the present invention is suited for notebook type environments. Similarly, the present invention can be employed to reduce the undesirable high EMI (electromagnetic interference) emissions. For example, notebook computers may generate excessive EMI emissions which can interfere with the navigational controls of airplanes. Thus, by reducing the horizontal scanning frequency in accordance with the present invention, such undesirable EMI emissions may be reduced.

Description of the invention is now continued with reference to a digital display unit having a maximum horizontal scanning frequency less than the origin frequency of a received display signal. Origin frequency generally refers to the frequency at which pixel data elements representative of an image are encoded in the display signal. Dot frequency, well known in the SVGA environment, is an example of origin frequency. Horizontal scanning frequency generally refers to the frequency at which pixels on digital display screen are refreshed. The digital display screen may be constrained in the speed of operation due to, for example, the electronic circuit (e.g., column drivers known in the art) which actuates the individual pixels on the digital display screen.

Broadly, the digital display unit samples the received display signal at a sampling frequency equal to the origin frequency, stores the sampled pixel data elements in a buffer, and retrieves the stored pixel data elements at a frequency slower that the sampling frequency. The digital display screen is scanned at this lower frequency in accordance with the present invention.

Even though the sampled data values are retrieved from the storage elements at a slower frequency, all the sampled data values can be used for generating display signals as the retrieval from storage can continue into the retrace time (non-display) of the received display signal. In other words, all the sampled data can be used for displaying images even though the scanning frequency is lower than the origin frequency. Accordingly, the interface enables the display of images encoded in the display signal received at a high origin frequency on a digital display screen operating at a lower scanning frequency.

One or more embodiments of the present invention can be implemented without departing from the scope and the spirit of the present invention as will be apparent to one skilled in the relevant arts by reading the description provided herein. Before describing the invention in great detail, it is useful to describe an example environment in which the invention can be implemented.

2. Example Environment

In a broad sense, the invention can be implemented in any computer system having a digital display unit. Such computer systems include, without limitation, lap-top and desk-top personal computer systems (PCS), work-stations, special purpose computer systems, general purpose computer systems, network computers, and many others. The invention may be implemented in hardware, software, firmware, or combination of the like.

Figure 2:
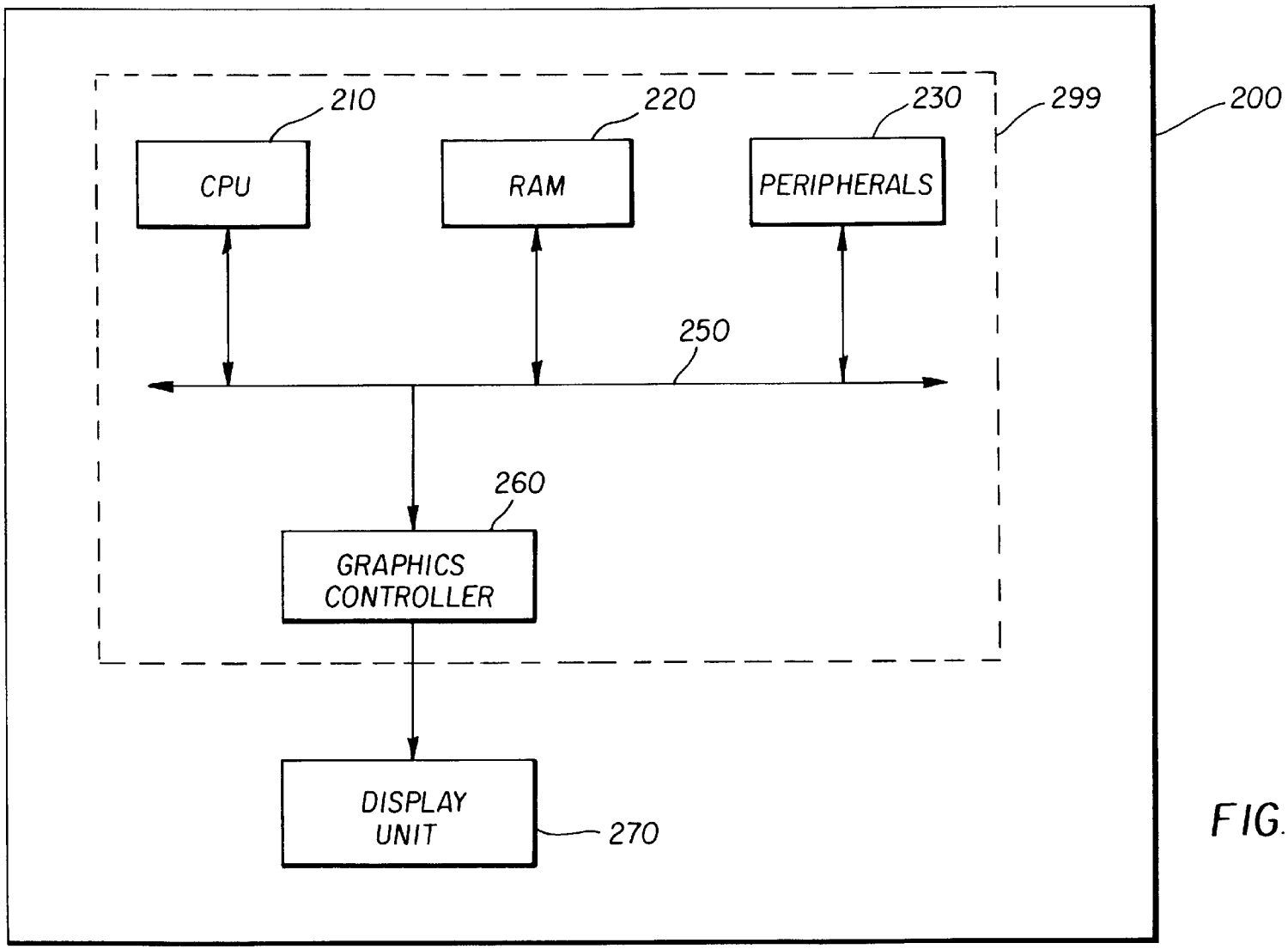
FIG. 2 is a block diagram of an example computer system illustrating an example environment in which the present invention can be implemented.

FIG. 2 is a block diagram of computer system 200 in which the present invention can be implemented. Computer system 200 includes central processing unit (CPU) 210, random access memory (RAM) 220, one or more peripherals 230, graphics controller 260, and digital display unit 270. CPU 210, RAM 220 and graphics controller 260 are typically packaged in a single unit, and such a unit is referred to as graphics source 299 as the display signal is generated by the unit. All the components in graphics source 299 of computer system 200 communicate over bus 250, which can in reality include several physical buses connected by appropriate interfaces.

RAM 220 stores data representing commands and possibly pixel data representing an image. CPU 210 executes commands stored in RAM 220, and causes different commands and pixel data to be transferred to graphics controller 260. Peripherals 230 can include storage components such as hard-drives or removable drives (e.g., floppy-drives). Peripherals 230 can be used to store commands and/or data which enable computer system 200 to operate in accordance with the present invention. By executing the stored commands, CPU 210 provides the electrical and control signals to coordinate and control the operation of various components.

Graphics controller 260 receives data/commands from CPU 210, generates display signals including display data and corresponding reference signals, and provides both to display unit 270. Display signals for analog display units are generally characterized by high non-display times to allow the scan electronics circuit to transition to the scan position from the end of one horizontal line to the beginning of the next horizontal line.

The display signal can be in analog form (e.g., RS-170 RGB signals) or digital form (e.g., PanelLink or LVDS standard known in the art). The display signal can be generated, for example, based on pixel data received from CPU 210 or from an external encoder (not shown). Alternatively, graphics controller 260 can generate pixel data representative of a new image based on commands received, for example, from CPU 210. Graphics controller 260 then generates a display signal based on such pixel data. In one embodiment, the signal is in the form of RGB signals and the reference signal includes the VSYNC and HSYNC signals well known in the art and explained in detail below. However, it should be understood that the present invention can be implemented with analog image data and/or reference signals in other standards. Examples of such standards include composite sync standard usually implemented on Macintosh Computer Systems and Sync on Green standard.

While generating a display signal from pixel data elements, graphics controller 260 uses an origin frequency to generate the display signal. Origin frequency generally refers to the frequency at which the pixel data elements are encoded as a display signal. Dot clock frequency, well known in the SVGA environment, is an example of such an origin frequency. There is a general need to have a high origin frequency as it allows higher refresh rates and finer display resolutions.

Digital display unit 270 receives the display signal from graphics controller 260 and generates display signals. The display signals cause an image to be generated on a digital display screen usually provided within display unit 270. In general, the individual pixel on the digital display screen are scanned at a scanning frequency (number of pixels actuated per second). Digital display units typically have a maximum scanning frequency at which they can operate.

This maximum scanning frequency can be less than the origin frequency at which display signals are received. In such circumstances, the images encoded in the display signals can be displayed by digital display unit 270 in accordance with the present invention. The present invention takes advantage of the high non-display times typically present in the display signals to provide such a functionality. For example, the non-display time in each horizontal display line can be as high as about 30% of the overall horizontal line period. In addition, as the origin frequency has increased (as explained in background section above) over time, the non-display time in each horizontal line has not decreased proportionate to the increase in the origin frequency. For example, in the early VGA systems, the retrace time was in the range of 4–5 micro-seconds in horizontal line having a period of about 31–32 micro-seconds. In contrast, in modern systems of the mid 1990, retrace time of 34 micro-seconds is common in display signals having a horizontal period of 11–12 micro-seconds.

As can be appreciated from the above numbers, the display signals are being provided at increasing origin frequencies. It may not be cost-effective to provide digital display units which can operate at such high origin frequencies. As a result origin frequencies can be higher than the horizontal scanning frequency of a digital display unit. At least to operate in such situations, digital display unit 270 includes an interface to scan digital display screen at a lower frequency by taking advantage of the high non-display times (retrace times) as explained below.

3. Method According to the Present Invention

Figure 3:
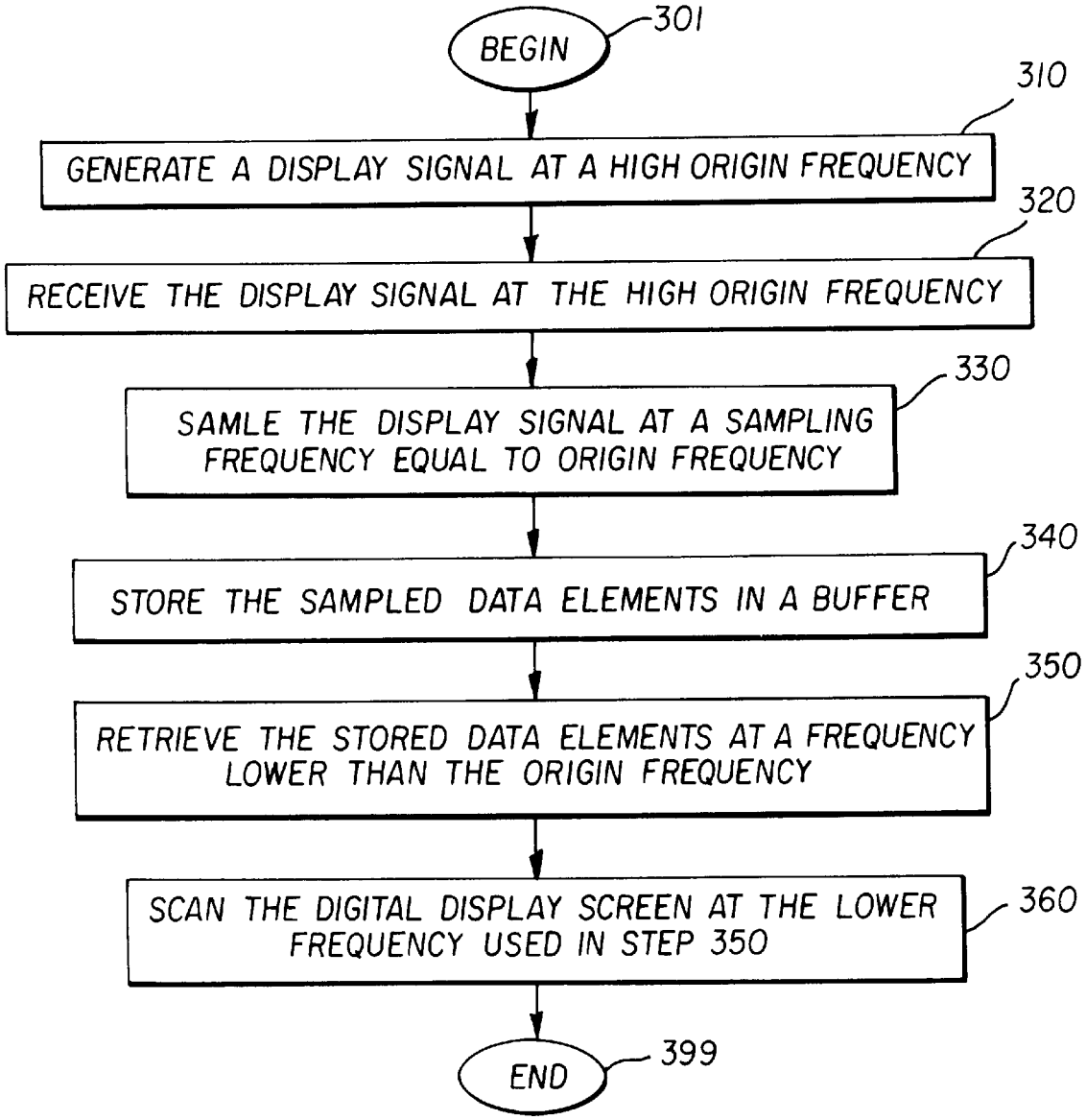
FIG. 3 is a flow-chart illustrating a method according to the present invention.

FIG. 3 is a flowchart illustrating the steps performed in a method according to the present invention. The steps will be explained with reference to the example computer system 200 of FIG. 2. In step 310, graphics source 299 generates a display signal at a high origin frequency in a known way. In step 320, display unit 270 receives a display signal at the high origin frequency.

In step 330, display unit 270 samples the display signal at a sampling frequency preferably equal to the origin frequency. Such sampling may also be performed in a known way. In step 340, digital display unit 370 stores the sampled data elements in a buffer which can be provided internal to digital display unit 370.

In step 350, the stored data elements are retrieved from the buffer at a frequency lower than the origin frequency. Even though the data elements are retrieved at a lower frequency (compared to the frequency at which they are stored), all the stored pixel elements can be retrieved (and display signals generated therefrom) by extending the retrieval time into the retrace time of the display signal. As more time is used for retrieving the sampled pixel data elements, a lower frequency can be used to scan the digital display screen. The timing relationship between read and write processes is illustrated with reference to FIG. 1 as explained below. In step 360, the digital display screen can be scanned at the lower frequency used in step 350. This lower frequency is less than the maximum scanning frequency of the digital display unit.

4. Timing Diagram Illustrating Step 350 of the Method of FIG. 3

FIG. 1 is a timing diagram illustrating the timing relationship of read and write transactions into a buffer (of step 350) in one embodiment of the present invention. FIG. 1 shows two signals SRC-HREF and DST-HREF. A high logical value on SRC-HREF signal indicates the time during which display data is received in an analog display signal. Such a time is referred to as source horizontal display time. The source horizontal display time for the received display signal is shown as $t_{A\text{-}src}$ (active source).

A low logical value on SRC-HREF signal indicates the horizontal retrace time. The retrace time is shown as $t_{R\text{-}src}$. The total horizontal time period of the received display signal $T_H$ equals $t_{A\text{-}src}$ plus $t_{R\text{-}src}$.

A high logical value on the DST-HREF signal indicates the presence of valid display data that can be used for generating display signals. Panel interface receives the display data and generates the display signals in response. A low logical value indicates the time (destination horizontal retrace) during which the display is transitioned to a subsequent horizontal line. During this destination retrace time (destination non-display time), several initialization operations (such as resetting counters) are typically performed as is well known in the art. The destination display time (high logical value) and destination retrace time (low logical value) are shown as $t_{A\text{-}dst}$ and $t_{R\text{-}dst}$ respectively.

To ensure that the images encoded in the received display signal are displayed without loss of display data, the horizontal lines need to be displayed at the rate as that at which the horizontal lines are received. Thus, $T_H=t_{A\text{-}src}+t_{R\text{-}src}=t_{A\text{-}dst}+t_{R\text{-}dst}$.

The present invention enables digital display screen to be scanned at a lower frequency (compared to origin frequency) by choosing destination display time $t_{A\text{-}dst}$ to be greater than source active time (or source display time) $t_{A\text{-}src}$. In other words, the scanning of horizontal lines continues into the retrace time of the received display signal.

The computation of several display signal processing parameters used in digital display units in accordance with the above discussion will be explained below.

5. Computation of Display Signal Processing Parameters in an Example Embodiment

The computation of parameters which can be used in processing the received display signal and generating the display signals will now be explained with reference to SVGA environment or the like. As explained above, to avoid data loss, the time ($T_{H\text{-}Src}$) for receiving each horizontal line must equal the time ($T_{H\text{-}Dst}$).

$$\text{Thus, } T_{H\text{-}Src}=T_{H\text{-}Dst}=T_H \quad \text{(Eq. 1)}$$

If $H_{Total\text{-}Src}$ represents the number of samples per each horizontal line received in a display signal, $$T_{SCLK}=T_H/H_{Total\text{-}Src} \quad \text{(Eq. 2)}$$

wherein $T_{SCLK}$ represents the clock period of the sampling clock. The sampling clock can also be used to store sampled pixel data elements into the buffer.

From Eq. 2, it follows:

$$F_{SCLK}=F_H\times H_{Total\text{-}Src} \quad \text{(Eq. 3)}$$

where $F_{SCLK}$ and $F_H$ respectively represent the source clock frequency and the horizontal line frequency of the received display signal.

As the present invention uses a different frequencies for sampling the received display signal and for scanning the digital display unit, $H_{Total\text{-}Dst}$ may not be equal to $H_{Total\text{-}Src}$. Thus, $$T_{Dclk}=T_H/H_{Total\text{-}Dst} \quad \text{(Eq. 4)}$$

$$F_{Dclk}=F_H\times H_{Total\text{-}Dst} \quad \text{(Eq. 5)}$$

wherein $F_{Dclk}$ represents the scanning frequency.

It is noted that the total number of samples $H_{Total}$ has two components, namely, the number of active samples taken in the source display data portion (hereafter width) and the number of inactive samples taken during retrace time ($H_{Ret}$). However, the number of points sampled in the source display portion of each horizontal line should equal the number of pixels displayed (or actuated) for each horizontal line. That is, width has the same value for both DST and SRC sides (at least when no scaling is performed).

From the above explanation, it follows:

$$H_{Total\text{-}Src}=\text{width}+H_{Ret\text{-}Src} \quad \text{(Eq. 6)}$$

$$H_{Total\text{-}Dst}=\text{width}+H_{Ret\text{-}Dst} \quad \text{(Eq. 7)}$$

By substituting equations 6 and 7 into equations 2, 3, 4, and 5, it follows:

$$T_{SCLK}=T_H/(\text{width}+H_{Ret\text{-}Src}) \quad \text{(Eq. 8)}$$

$$T_{Dclk}=T_H/(\text{width}+H_{Ret\text{-}Dst}) \quad \text{(Eq. 9}$$

OR $$F_{SCLK}=F_H\times(\text{width}+H_{Ret\text{-}Src}) \quad \text{(Eq. 10)}$$

$$F_{Dclk}=F_H\times(\text{width}+H_{Ret\text{-}Dst}) \quad \text{(Eq. 11)}$$

Thus, if $H_{Ret\text{-}Dst}<H_{Ret\text{-}Src}$, $F_{DCLK}<F_{SCLK}$.

From the above, it can readily appreciated that the scan frequency can be implemented to be lower than the origin frequency (sampling frequency) by an appropriate choice of the $H_{Ret\text{-}Dst}$ value. It will be apparent to one skilled in the relevant arts by reading the description provided herein how to implement several embodiments without departing from the scope and spirit of the present invention.

The principles underlying the present invention will be explained in further detail below with reference to a numerical example. An example embodiment implementing the present invention will then be described.

6. Numerical Example Illustrating the Principles Underlying the Present Invention For purpose of illustration, assume a display signal being received at a frame rate of 60 Hz (i.e., $F_v$=60 Hz), with each frame encoding a 1280×1024 size image. As is well known in the SVGA type environments, each frame (including the vertical and horizontal retrace times) includes 1100 horizontal lines ($V_{total}$=1100 lines), with each horizontal line being sampled 1600 times (i.e., $H_{total\text{-}Src}$=1600). This corresponds to a line frequency of approximately 66 KHz (i.e., $F_H$=66 KHZ).

From the above, $F_{SCLK}=F_v\times H_{total_src}\times V_{total}$=105 MHZ

Width=1280 and $H_{ret\text{-}Src}$=320

On the scanning side (or reading from the buffer), the retrace time can be considerably shorter. For example, $H_{ret_dst}$ can be in the range of 4 to 32. For most panels in the market place a value of 32 may be sufficient. Assuming $H_{ret\text{-}Dst}$=32, we have:

$$H_{Total\text{-}Dst}=\text{width}+H_{ret\text{-}dst}=1280+32=1312$$

$$F_{DCLK}=F_v\times H_{total\text{-}Dst}\times V_{total}=86.59 \text{ MHZ}$$

Or using Equation 11 from above, $$F_{DCLK}=(\text{width}+H_{ret_Dst})\times F_H=(1280+32)\times 66 \text{ KHz}=86.59 \text{ MHZ}.$$

Thus, the display signal may be sampled at a frequency of 105.6 MHZ, but the digital display screen may be scanned at a frequency of 86.59 MHZ. Thus, a digital display screen can be scanned at a frequency lower than the origin frequency of a display in accordance with the present invention. An embodiment implementing the present invention will be explained below in further detail.

7. Example Embodiment of Digital Display Unit

Figure 4:
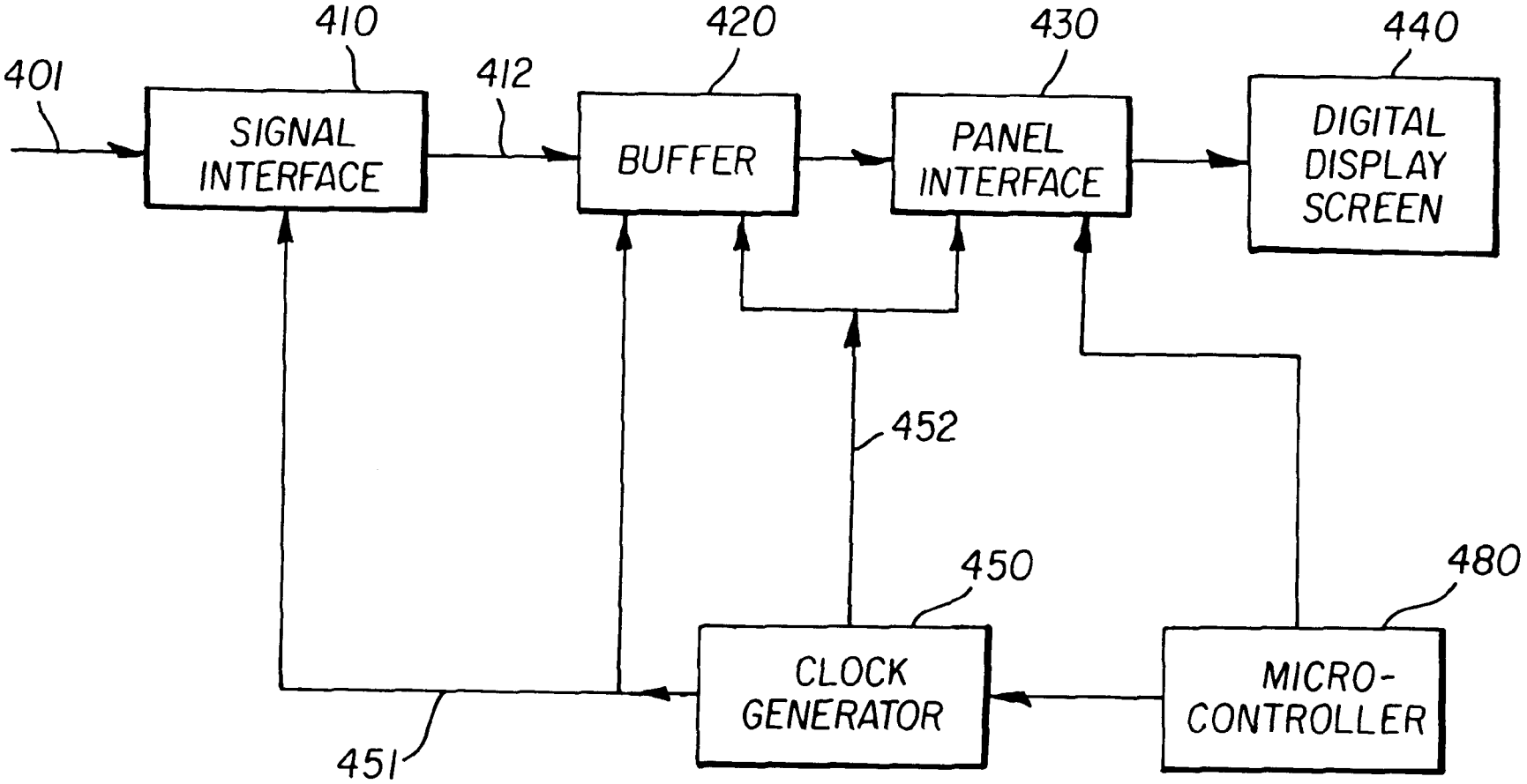
FIG. 4 is a block diagram illustrating the components of a digital display unit in which the present invention can be implemented.

FIG. 4 is a block diagram of digital display unit 270 including display signal interface 410, buffer 420, panel interface 430, digital display screen 440, clock generator circuit 450, and micro controller 480. Each of these components is explained in further detail below.

Clock generator 450 generates sampling clock (line 451) with a frequency of $F_{sclk}$ and a horizontal scanning clock (line 452) with a frequency of $F_{dclk}$. The sampling clock frequency typically equals the origin frequency of the received display signals. Sampling clock is typically phase locked to the synchronization signals received with the analog display signal. As explained above, the frequency $F_{dclk}$ is less than the maximum frequency at which the digital display screen 440 can be scanned. Micro-controller 480 controls the exact value of $F_{dclk}$ by setting the appropriate parameters in clock generator 450 as will be apparent to one skilled in the relevant arts by reading the description provided herein.

The sampling clock is used by display signal interface 410 for sampling the display signal received on line 401. The resulting pixel data elements are stored in buffer 420 and retrieved using the scanning clock. An embodiment of clock generator 450 and one way in which microcontroller 480 can control the exact value of $F_{dclk}$ is explained in co-pending patent application entitled, "A Method and Apparatus for Clock Recovery in a Digital Display Unit", Filed Feb. 24, 1997, having Ser. No. 08/803,824 and Attorney Docket Number: PRDN-0002.

Display signal interface 410 provides the signaling interface for the display signal received on line 401, and generates sample pixel data elements representative of the image encoded in the received display signal. The display signal can be in analog form or digital form. If the received signal comprises an analog display signal, display signal interface 410 may include an analog-to-digital converter (ADC), which samples the analog signal received on line 401 according to sampling clock 451 received from clock generator 450. The sampled data values are provided on line 412 to buffer 420, preferably it the sampling clock frequency. Display signal interface 410 can be conventional. If the received signal comprises a digital display signal (e.g., of PanelLink standard), display signal interface 410 generates the sampled pixel data element values encoded in the received display signal in a known way.

Buffer 420 stores the sampled pixel data elements representative of the images encoded in the display signal for sufficient time to enable the sampled data values to be retrieved using the slower $F_{dclk}$ frequency. The stored samples correspond to the active display portion included in the received display signal. This slower frequency can be within a range as determined by the extent of the retrace times in the received analog display signal. Specifically, as explained above, different values of $H_{ret\text{-}dst}$ can be chosen to achieve different frequencies. A lower value of $H_{ret\text{-}dst}$ generally implies a lower $F_{dclk}$ frequency.

Buffer 420 can include a memory element of any size. The required memory size is generally proportional to the difference of the sampling frequency and scanning frequency. In one embodiment, buffer 420 includes sufficient memory to store a maximum of scan line of pixel data elements. Buffer 420 can be organized as a circular buffer, and such a structure enables the data to be written and read at different speeds as will be apparent to one skilled in the art.

In an alternative embodiment, buffer 420 comprises a line buffer sufficient to store at least two lines of sampled pixel data elements. In such a case, buffer 420 can also be used to upscale the image represented by the sampled pixel data elements. This embodiment for upscaling is described in further detail in co-pending patent application entitled, "A Method and Apparatus for Upscaling an Image", Filed Feb. 24, 1997, having Ser. No. 08/804,623 and Attorney Docket Number: PRDN-0001, and is incorporated in its entirety by reference herein. In such an embodiment, buffer 420 (with sufficient memory space to store two lines of data) serves the dual purpose of enabling upscaling, or in the alternative to enable digital display screen to be scanned at a lower scanning frequency as explained herein.

Digital display screen 440 includes several pixels which are actuated by panel interface 430. Such actuation results in images being generated on digital display screen 440. Panel interface 430 receives DST_HREF signal (shown in FIG. 1) and clock signal with frequency $F_{dclk}$, and generates display signals to actuate the individual pixels on digital display screen 430. The digital display screen is scanned at a frequency of $F_{dclk}$. As explained above, the frequency $F_{dclk}$ is less than both the origin frequency of the display signal and the maximum scanning frequency of the digital display screen 430. The implementation of various combinations of panel interface 430 and digital display screen 440 will be apparent to one skilled in the relevant arts.

Thus, by properly utilizing the horizontal non-display time present in the received display signals, the present invention enables display signals received at high origin frequencies to be displayed on digital display screen having lower scanning frequencies. This capability is provided by changing the operation of components which may be other wise required, and without substantially redesigning the display panel interface. As a result, the present invention may be implemented in a cost-effective manner.

8. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A digital display unit for displaying images encoded in a display signal, said images being encoded in said display signal at ail origin frequency, each of said images being encoded in a frame included in said display signal, each of said frames including a plurality of horizontal lines, each of said horizontal lines including an active display portion and a non-display portion received during a source active display time and a source non-display time respectively, said active display portions representing said images, said digital display unit comprising:

a digital display screen comprising a plurality of horizontal scan lines for displaying said images encoded in said display signal;

a display signal interface for receiving said display signal, and sampling said active display portions using a sampling frequency clock signal to generate a plurality of sampled pixel data elements representative of said images encoded in said display signal, wherein said sampling frequency clock has a frequency equal to said origin frequency;

a clock generator circuit for generating said sampling frequency clock signal and a lower frequency clock signal, wherein said lower frequency clock signal has a constant frequency;

a buffer coupled to said display signal interface, said buffer receiving and storing said plurality of sampled pixel data elements representative of said images encoded in said display signal, wherein said plurality of sampled pixel data elements are retrieved from said buffer using said lower frequency clock signal; and a panel interface coupled to said buffer, said panel interface receiving said plurality of sampled pixel data elements from said buffer at said lower frequency clock signal, said panel interface generating display signals to said digital display screen according to said plurality of sampled pixel data elements using said lower frequency clock signal, wherein said display signals cause said images to be generated on said digital display screen, wherein said panel interface generates said display signals for each of said plurality of horizontal scan lines during a destination display time and transitions to a subsequent horizontal scan line during a destination non-display time, wherein said destination display time is greater than said source active display time, and said destination display time plus said destination non-display time is equal to said source active display time plus said source non-display time, such that said digital display screen is scanned at a horizontal scan rate equal to the rate at which said plurality of horizontal lines of each of said frames are received.

2. The digital display unit of claim 1, wherein said digital display screen can be scanned at a maximum horizontal scanning frequency which is lesser than said origin frequency, and wherein said panel interface causes said digital display screen to be scanned at said lower frequency clock signal, wherein said lower frequency clock signal has a frequency less than said maximum horizontal scanning frequency.

3. The digital display unit of claim 1, wherein said digital display screen is scanned at at said lower frequency clock signal to consume lesser amount of electrical power that would be consumed by scanning at higher frequencies.

4. The digital display unit of claim 1, wherein said digital display screen is scanned at said lower frequency clock signal to reduce the EMI emissions which would be generated by said digital display unit.

5. The digital display unit of claim 1, wherein said source active display time plus said source non-display time equal said destination active display time plus said destination non-display time.

6. The digital display unit of claim 1, wherein said display signal comprises an analog display signal, and said display signal interface comprises an analog to digital converter (ADC).

7. The digital display unit of claim 6, wherein said display signal is encoded according to SVGA type standard.

8. The digital display unit of claim 1, wherein said display signal comprises a digital display signal.

9. The digital display unit of claim 1, wherein said buffer includes sufficient storage to store less than or equal to one horizontal line.

10. The digital display unit of claim 1, wherein said buffer comprises a line buffer sufficient to store two horizontal lines of data, and wherein said buffer is also used for upscaling said images.

11. The digital display unit of claim 1, wherein said lower frequency clock signal has an average clock frequency which is lower than the average frequency of said sampling clock signal.

12. A display circuit for use in a digital display unit, said display circuit for displaying images encoded in a display signal on a digital display screen included in said digital display unit, said digital display screen including a plurality of horizontal lines, said images being encoded in said display signal at an origin frequency, each of said images being encoded in a frame included in said display signal, each of said frames including a plurality of horizontal lines, each of said horizontal lines including an active display portion and a non-display portion received during a source active display time and a source non-display time respectively, said active display portions representing said images, said display circuit comprising:

a display signal interface for receiving said display signal, and sampling said active display portions using a sampling frequency clock signal to generate a plurality of sampled pixel data elements representative of said images encoded in said display signal, wherein said sampling frequency clock has a frequency equal to said origin frequency;

a buffer coupled to said display signal interface, said buffer receiving and storing said plurality of sampled pixel data elements representative of said images encoded in said display signal; and a clock generator circuit for generating said sampling frequency clock signal and a lower frequency clock signal, wherein said lower frequency clock signal has a constant frequency, wherein said plurality of sampled pixel data elements are retrieved from said buffer using said lower frequency clock signal and provided to a panel interface, said panel interface receiving said plurality of sampled pixel data elements from said buffer at said lower frequency clock signal and generating display signals to said digital display screen according to said plurality of sampled pixel data elements, wherein said display signals cause said images to be generated on said digital display screen, wherein said panel interface generates said display signals for each of said plurality of horizontal scan lines during a destination display time and transitions to a subsequent horizontal scan line during a destination non-display time, wherein said destination display time is greater than said source active display time, and said destination display time plus said destination non-display time is equal to said source active display time plus said source non-display time, such that said digital display screen is scanned at a horizontal scan rate equal to the rate at which said plurality of horizontal lines of each of said frames are received.

13. The display circuit of claim 12, wherein said digital display screen can be scanned at a maximum horizontal scanning frequency which is lesser than said origin frequency, and wherein said panel interface causes said digital display screen to be scanned at said lower frequency clock signal, wherein said lower frequency clock signal has a frequency less than said maximum horizontal scanning frequency.

14. The display circuit of claim 12, wherein said digital display screen is scanned at said lower frequency clock signal to consume lesser amount of electrical power that would be consumed by scanning at higher frequencies.

15. The display circuit of claim 12, wherein said digital display screen is scanned at said lower frequency clock signal to reduce the EMI emissions which would be generated by said digital display unit.

16. The display circuit of claim 12, wherein said source active display time plus said source non-display time equal said destination active display time plus said destination non-display time.

17. The display circuit of claim 12, wherein said display signal comprises an analog display signal, and said display signal interface comprises an analog to digital converter (ADC).

18. The display circuit of claim 17, wherein said display signal is encoded according to SVGA type standard.

19. The display circuit of claim 12, wherein said display signal comprises a digital display signal.

20. The display circuit of claim 12, wherein said buffer includes sufficient storage to store less than or equal to one horizontal line.

21. The display circuit of claim 12, wherein said buffer comprises a line buffer sufficient to store two horizontal lines of data, and wherein said buffer is also used for upscaling said images.

22. The display circuit of claim 12, wherein said lower frequency clock signal has an average clock frequency which is lower than the average frequency of said sampling clock signal.

23. A display circuit for use in a digital display unit, said display circuit for displaying images encoded in a display signal on a digital display screen included in said digital display unit, said digital display screen including a plurality of horizontal lines, said images being encoded in said display signal at an origin frequency, each of said images being encoded in a frame included in said display signal, each of said frames including a plurality of horizontal lines, each of said horizontal lines including an active display portion and a non-display portion received during a source active display time and a source non-display time respectively, said active display portions representing said images, said display circuit comprising:

means for receiving said display signal, and sampling said active display portions using a sampling frequency clock signal to generate a plurality of sampled pixel data elements representative of said images encoded in said display signal, wherein said sampling frequency clock has a frequency equal to said origin frequency;

means for storing coupled to said means for receiving, said means for storing receiving and storing said plurality of sampled pixel data elements representative of said images encoded in said display signal; and means for generating said sampling frequency clock signal and a lower frequency clock signal, wherein said lower frequency clock signal has a constant frequency, wherein said plurality of sampled pixel data elements are retrieved from said means for storing using said lower frequency clock signal and provided to a panel interface, said panel interface receiving said plurality of sampled pixel data elements from said means for storing at said lower frequency clock signal and generating display signals to said digital display screen according to said plurality of sampled pixel data elements, wherein said display signals cause said images to be generated on said digital display screen, wherein said panel interface generates said display signals for each of said plurality of horizontal scan lines during a destination display time and transitions to a subsequent horizontal scan line during a destination non-display time, wherein said destination display time is greater than said source active display time, and said destination display time plus said destination non-display time is equal to said source active display time plus said source non-display time respectively, such that said digital display screen is scanned at a horizontal scan rate equal to the rate at which said plurality of horizontal lines of each of said frames are received.

24. The display circuit of claim 23, wherein said lower frequency clock signal has an average clock frequency which is lower than the average frequency of said sampling clock signal.

25. A method of displaying images encoded in a display signal on a digital display screen of a digital display unit, said digital display screen comprising a plurality of horizontal scan lines, said images being encoded in said display signal at an origin frequency, each of said images being encoded in a frame included in said display signal, each of said frames including a plurality of horizontal lines, each of said horizontal lines including an active display portion and a non-display portion received during a source active display time and a source non-display time respectively, said active display portions representing said images, said method comprising the steps of:

receiving said display signal;

sampling said active display portions of said display signal using a sampling frequency clock signal to generate a plurality of sampled pixel data elements representative of said images encoded in said display signal, wherein said sampling frequency clock has a frequency equal to said origin frequency;

storing in a buffer said plurality of sampled pixel data elements representative of said images encoded in said display signal;

generating said sampling frequency clock signal and a lower frequency clock signal, wherein said lower frequency clock signal has a constant frequency;

retrieving said plurality of sampled pixel data elements from said buffer using said lower frequency clock signal; and generating display signals at said lower frequency clock signal to said digital display screen based on said plurality of sampled pixel data elements, wherein said display signals cause said images to be generated on said digital display screen, wherein said panel interface generates said display signals for each of said plurality of horizontal scan lines during a destination display time and transitions to a subsequent horizontal scan line during a destination non-display time, wherein said destination display time is greater than said source active display time, and said destination display time plus said destination non-display time is equal to said source active display time plus said source non-display time respectively, such that said digital display screen is scanned at a horizontal scan rate equal to the rate at which said plurality of horizontal lines of each of said frames are received.

26. The method of claim 25, wherein said source active display time plus said source non-display time equal said destination active display time plus said destination non-display time.

27. The method of claim 25, wherein said display signal comprises an analog display signal, and said display signal interface comprises an analog to digital converter (ADC).

28. The method of claim 25, wherein said display signal is encoded according to SVGA type standard.

29. The method of claim 25, wherein said display signal comprises a digital display signal.

30. The method of claim 25, wherein said lower frequency clock signal has an average clock frequency which is lower than the average frequency of said sampling clock signal.

* * * * *